US006419570B1

(12) United States Patent
Werner

(10) Patent No.: US 6,419,570 B1
(45) Date of Patent: Jul. 16, 2002

(54) HOLDING DEVICE FOR A SPECTACLE GLASS

(75) Inventor: Ralf Werner, Hilden (DE)

(73) Assignee: Wernicke & Co. GmbH, DEX ( * ) Notice: Subject to any disclaimer, the term of this patent is extended or adjusted under 35 U.S.C. 154(b) by 0 days.

(21) Appl. No.: 09/720,946

(22) PCT Filed: Apr. 22, 2000

(86) PCT No.: PCT/EP00/03669

§ 371 (c)(1),
(2), (4) Date: Feb. 8, 2001

(87) PCT Pub. No.: WO00/66325

PCT Pub. Date: Nov. 9, 2000

(30) Foreign Application Priority Data

May 3, 1999 (DE) ..... 199 20 204

(51) Int. Cl.[7] ..... B24B 41/04

(52) U.S. Cl. ..... 451/390; 451/384; 451/388; 451/43

(58) Field of Search ..... 451/388–390, 451/42, 384, 460, 255, 256, 43; 269/13, 21, 22

(56) References Cited

U.S. PATENT DOCUMENTS

| | | | | | |
|---|---|---|---|---|---|
| 3,631,637 A | | 1/1972 | Tagnon | | |
| 3,886,696 A | * | 6/1975 | Bruck | | 451/384 |
| 3,978,620 A | * | 9/1976 | Feneberg et al. | | 451/388 |
| 4,164,099 A | * | 8/1979 | Grant | | 451/388 |
| 4,598,502 A | * | 7/1986 | Lombard | | 451/390 |
| 4,669,226 A | * | 6/1987 | Mandler | | 451/388 |
| 5,421,771 A | * | 6/1995 | Wardle | | 451/390 |

FOREIGN PATENT DOCUMENTS

| | | | | |
|---|---|---|---|---|
| DE | 1919248 | | 11/1969 | |
| DE | 4230610 | | 4/1993 | |
| DE | 4414784 | | 11/1995 | |
| JP | 60-056863 | | 4/1985 | |
| JP | 250963 | * | 9/1992 | 451/388 |

* cited by examiner

*Primary Examiner*—George Nguyen
(74) *Attorney, Agent, or Firm*—Ostrolenk, Faber, Gerb & Soffen, LLP

(57) ABSTRACT

Holding device for a spectacle lens for the purpose of inserting and removing the spectacle lens into or from a container and/or of mounting and removing it on or from a spectacle lens holding shaft of a spectacle lens edge processing machine by means of a handling apparatus, which holding device comprises a base which is held by the handling apparatus and has a depression, a controllable vacuum-pressure connection at the depression, and a spherical cap, which is arranged in the depression, bears tightly against an annular surface of the depression and has an opening to the depression and a sealing region at the edge of the spherical cap for the purpose of bearing against an optical surface of the spectacle lens.

6 Claims, 2 Drawing Sheets

HOLDING DEVICE FOR A SPECTACLE GLASS

Figure 1:
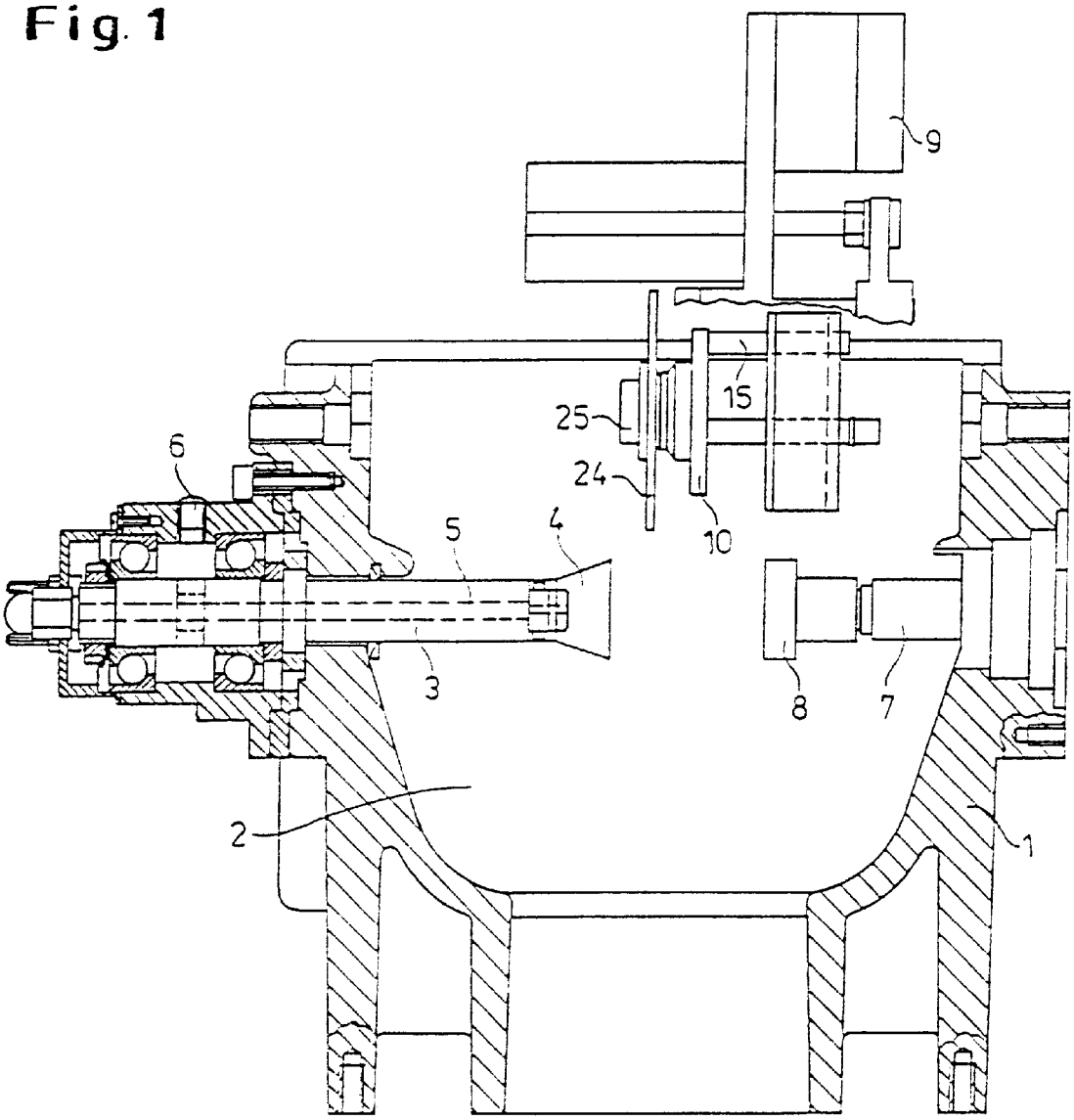

The invention relates to the use of a holding device for a spectacle lens for the purpose of inserting and removing the spectacle lens into or from a container and/or of mounting and removing it on or from a spectacle lens holding shaft of a spectacle lens edge processing machine by means of a handling apparatus.

Such a holding device is described in conjunction with a system for processing the circumferential edge and/or an optical surface of spectacle lenses in DE 44 14 784 C2 of the same applicant. In the case of this system, a blank is initially inserted by means of a handling apparatus into an optoelectronic detecting device which has an electronic image processing and evaluation system for detecting customary markings such as dots, crosses and notches at the edge of the blank, or the position of an adjacent part. The electronic image processing and evaluation system of the optoelectronic detection device transmits signals to a control device for the handling apparatus, such that the blank can be inserted accurately in position by means of the handling apparatus into a holder, in particular a spectacle lens holding shaft of a spectacle lens edge processing machine.

In order to manipulate the blank, the handling apparatus has a movable holding device with a single sucker for inserting the blank into the detecting device, and several suckers arranged arcuately for the purpose of transferring the blank from the detection device into the spectacle lens edge processing machine. The suckers are arranged in this case on an annular segment which can be rotated relative to the holding device and whose rotation axis is perpendicular to the individual suckers. The arcuately arranged suckers can be used to grip a blank in the region of the edge and transfer it from a three-point support of the optoelectronic detecting device onto or into the spectacle lens holding shaft of the spectacle lens edge processing machine, the middle region around the optical axis of the blank remaining free for the purpose of attaching the soft elastic head on the swivel arm of the optoelectronic detecting device, or of inserting it into the spectacle lens holding shaft in the spectacle lens edge processing machine.

Underpressure can be applied to the suckers for the purpose of holding the blank. The central sucker on the holding device serves the purpose of removing a blank from a container and placing it onto the three-point support of the optoelectronic detecting device, while the suckers arranged on the annular segment grip from above or from below a spectacle lens blank lying on the three-point support, and insert it into the spectacle lens holding shaft, as a result of which it is ensured that no impediment can arise from the guide rod with the soft elastic head or from the spectacle lens holding shaft. It is also mentioned, however, that a blank can also be inserted by means of the central sucker into the spectacle lens holding shaft when it is ensured that the blank is initially held on one side on the spectacle lens holding shaft, and when the spectacle lens holding shaft can be moved apart to such an extent that the holding device can be moved into this region and a blank can also be inserted by means of this sucker.

It is the object of the invention to create a holding device which is suitable for holding a spectacle lens by means of a central sucker and for inserting it into a spectacle lens holding shaft with positional accuracy, in particular with axial accuracy with reference to the optical surface of the blank opposite the holding device, the aim being for this holding device to be fashioned such that it can be used with conventional spectacle lens edge processing machines whose spectacle lens holding shaft does not need to be adapted to the holding device.

Starting from this formulation of the problem, it is proposed to use a holding device which comprises a base which is held by the handling apparatus and has a depression, a controllable vacuum-pressure connection at the depression, and a spherical cap which is arranged in the depression, bears tightly against an annular surface of the depression and has an opening to the depression and a sealing region at the edge of the spherical cap for the purpose of bearing against an optical surface of the spectacle lens in order to insert and remove the spectacle lens into or from a container and/or for the purpose of being mounted and removed on or from a spectacle lens holding shaft in a spectacle lens edge processing machine by means of a handling apparatus which holds the base.

If, with the vacuum pressure not applied, the spherical cap is placed onto an optical surface of a blank, it is adapted to any desired angular position of this optical surface, while the opposite optical surface maintains its position. If the vacuum pressure is applied, the blank is held in the sealing region at the edge of the spherical cap, while the spherical cap is drawn against the annular surface of the depression in the base and is held in this position owing to the friction between the annular surface of the depression and the complementary surface of the spherical cap. If, by means of the handling apparatus, the blank is now brought between the separated halves of a spectacle lens holding shaft in a spectacle lens edge processing machine, the blank can be positioned with its free surface accurately in position and precisely coaxial with the axis of this spectacle lens holding shaft, and be fastened there in a suitable way. This can be performed in such a way that the blank is moved with the free optical surface directly against a clamping sleeve, to which vacuum pressure can be applied, on this half of the spectacle lens holding shaft, and is held by the application of vacuum pressure. It is possible furthermore, to provide the optical surface, opposite the holding device, of the blank in a centering device with a conventional block or sucker which can be inserted accurately in position and coaxially in a corresponding clamping sleeve on the corresponding half of the spectacle lens holding shaft. In this case, as well, it is possible in addition to apply vacuum pressure to the clamping sleeve in order to increase the holding force. After the blank has been mounted on one half of the spectacle lens holding shaft, the vacuum pressure of the spherical cap is neutralized, the holding device is moved out of the region of the spectacle lens holding shaft, the second half of the spectacle lens holding shaft is pressed against the now free optical surface of the blank, and the edge processing can begin.

The annular surface of the depression in the base can be designed so as to yield a linear contact of the surface of the spherical cap. In order to improve the sealing effect, and reduce the areal pressure occurring in this region owing to the application of vacuum pressure, it is advantageous for the annular surface of the depression to be designed as a spherical surface complementary to the spherical cap. The spherical cap can advantageously be movably fastened on the base by means of a mushroom-shaped holder guided through the opening so that it cannot be lost when the application of vacuum pressure is neutralized.

The spherical cap can be produced overall from an elastic synthetic material, but preferably has a soft lip seal in the sealing region, thus ensuring good adaptation to and sealing on a nonspherical optical surface of the blank. The dimensions of the base with the spherical cap arranged therein are only negligibly greater than those of a conventional block or sucker, with the result that the holding device according to the invention can be moved without difficulty with a blank into the region of the separated halves of the spectacle lens holding shaft. If the base is enlarged or lengthened in the shape of a plate on at least one side, a retaining bolt can be arranged at an edge region for the purpose of fastening on the handling apparatus. This eccentric arrangement of the retaining bolt ensures that the region of the spectacle lens holding shaft remains completely free of elements of the handling apparatus.

The plate-shaped design and the arrangement of a retaining bolt in the edge region is also associated with an advantageous guidance of the vacuum-pressure connection which can be guided in the form of bores from the depression through the plate-shaped enlargement of the base and the retaining bolt.

Figure 2:
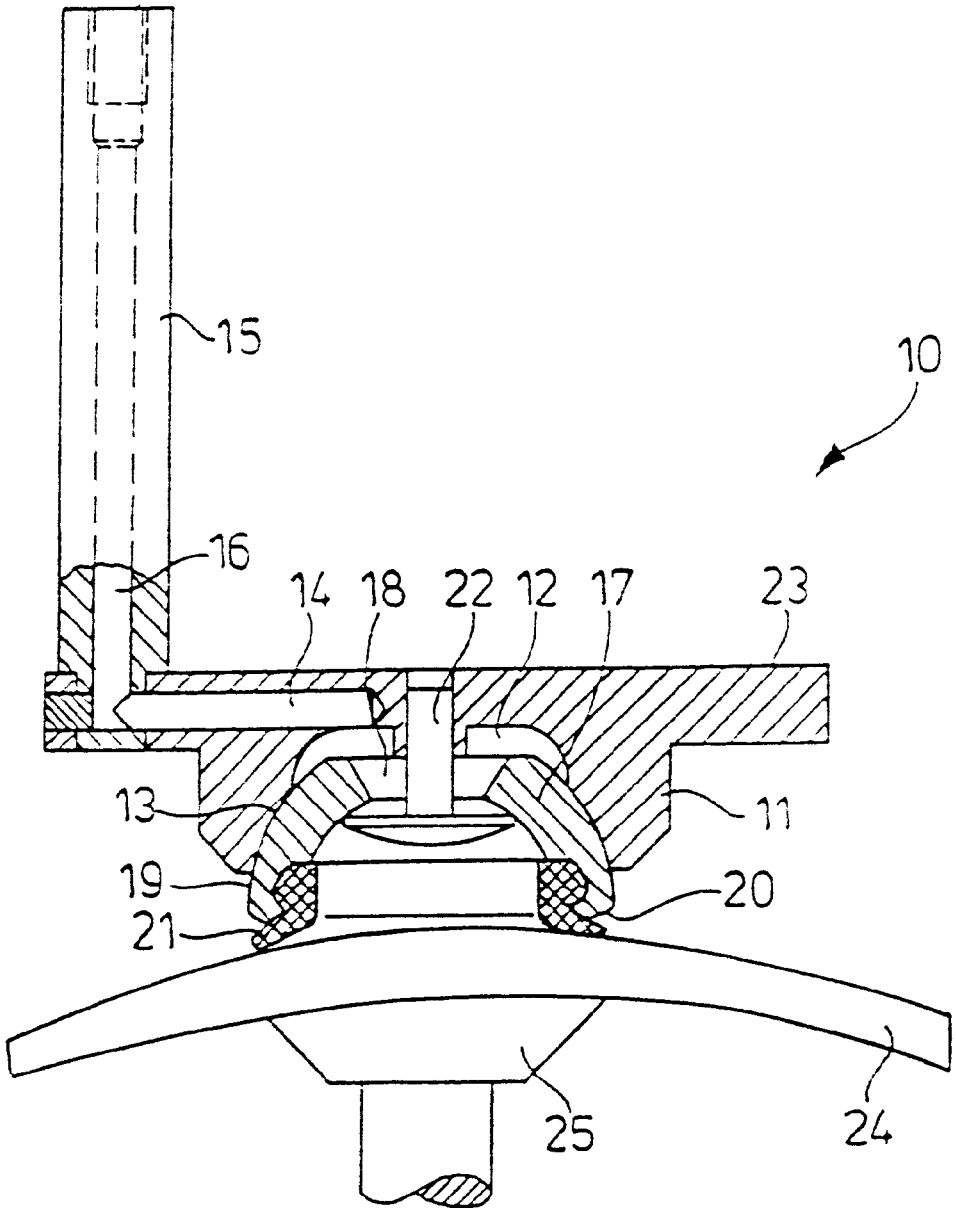

The invention is explained in more detail below with the aid of an exemplary embodiment shown in the drawing, in which:

FIG. 1 shows a schematic sectional view of a housing part of a spectacle lens edge grinder with the grinding chamber and a spectacle lens holding shaft arranged therein, and FIG. 2 shows an enlarged sectional illustration of the holding device.

Of a spectacle lens edge processing machine, all that is illustrated is a sectional view of a housing region 1 which shows a processing chamber 2 for a blank and the halves 3, 7 of a spectacle lens holding shaft. The rotatable part 3, which cannot be displaced axially, is denoted as a centering shaft and supports at its free end a clamping sleeve 4 to which vacuum pressure can be applied via an axial bore 5 in the centering shaft 3. A vacuum-pressure connection 6 is provided for this purpose on the housing 1 in the region of the bearing of the centering shaft 3. Arranged coaxially with the centering shaft 3 is the second half 7 of the spectacle lens holding shaft, which is denoted as clamping shaft and can be displaced axially. A spherical adapter 8 with a soft supporting clamping ring is arranged at the free end of this clamping shaft 7. A handling apparatus 9 on which a holding device 10 is arranged can be used to remove a blank 24 from a container (not illustrated) and move it between the region between the centering shaft 3 and the axially retracted clamping shaft 7.

Reference is made to the already mentioned DE 44 14 784 C2 with regard to the details.

It is essential that the surface, facing the clamping sleeve 4, of the blank 24 is situated with its axis exactly coaxial with the axis of the centering shaft 3 when the blank 24 is mounted on the clamping sleeve 4, and this independently of which angular position the surface of the blank 24, which is held by the holding device 10, assumes.

In the illustrated exemplary embodiment, a block or sucker 25 is mounted by means of a conventional centering device on the optical surface, opposite the holding device 10, of the blank 24, and its axis likewise runs coaxially with the axis of the centering shaft 3 when the handling apparatus 9 mounts the blank on the clamping sleeve 4. The block or sucker 25 can also be held in the clamping sleeve 4 by vacuum pressure when it is sealed in a suitable way from the clamping sleeve 4, since reliable holding on the centering shaft 3 is already ensured in this way when the holding device 10 is loosened by neutralizing the vacuum pressure and before the spherical adapter 8 is pressed against the blank 24 by axial movement of the clamping shaft 7.

The holding device 10 is shown on an enlarged scale in FIG. 2 and comprises a base 11 with a depression 12. The base 11 has an annular surface 13 which is shaped as a spherical cap which is complementary to an outer spherical cap surface 19 of a spherical cap 17.

The base 11 has a plate-shaped extension 23 on whose edge region a retaining bolt 15 is fastened. The handling apparatus 9 acts on this retaining bolt 15. A radial bore 14 leads from the depression 12 to an axial bore 16 in the retaining bolt 15. Vacuum pressure can be applied in a controlled fashion to the depression 12 via these bores 14, 16. Inserted into the depression 12 is a spherical cap 17 whose spherical cap surface 19 bears sealingly against the annular surface 13. The spherical cap 17 is held on the base 11 by means of a mushroom-shaped holder 22 which is guided through an opening 18 in the spherical cap 17. An edge 20 of the spherical cap 17 is provided with an annular, soft lip seal 21.

The blank 24 provided with a block or sucker 25 in a conventional centering device is arranged, for example, lying horizontally in a container from which it is intended to be removed by means of the holding device 10. In this case, the block or sucker 25 is plugged into a holder in the container which determines the position of the block or sucker 25 and of the optical surface of the blank 24 on which the block or sucker 25 is fastened.

The optical surface, opposite the block or sucker 25, of the blank 24, on which the holding device 10 is to be mounted, can, by contrast, have a different angular position which can be determined by virtue of the fact that the blank 24 is provided with a prismatic or cylindrical finish.

If the holding device 10 is now placed onto this surface, the spherical cap 17 adapts to the angular position of this optical surface, while the associated position of the block or sucker 25 or of the optical surface against which this block or sucker 25 bears remains unchanged.

When vacuum pressure is applied via the bores 16, 14, the spherical cap 17 sealed by means of the lip seal 21 is sucked firmly against the blank 24 and is drawn into the depression 12, with the result that the friction between the annular surface 13 and the spherical cap surface 19 prevents any displacement.

As already described with reference to FIG. 1, the blank 24 can now be mounted on the clamping sleeve 4 of the centering shaft 3, and is securely held there, likewise by applying vacuum pressure. After the vacuum pressure applied to the holding device 10 is neutralized, the latter can be moved out from the region of the centering shaft 3 and the axially displaceable clamping shaft 7, after which the spherical adapter 8 is moved with the supporting clamping ring against the blank 24. The spherical adapter 8 adapts exactly as the spherical cap 17 to the angular position of the optical surface of the blank 24 against which this spherical adapter 8 is pressed, such that even when the blank 24 is being clamped between the centering shaft 3 and the clamping shaft 7 no change occurs to the angular position of the optical surface of the blank 24, which faces the clamping sleeve 4.

The blank 24 can also be mounted on the clamping sleeve 4 without prior mounting of a block or sucker 25 when said clamping sleeve is provided with a ring seal, as has already been described with reference to the spherical cap 17. In this case, as well, the angular position of the surface, bearing against the clamping sleeve 4, of the blank 24 is uniquely determined.

What is claimed is:

1. The use of a holding device for a spectacle lens comprising a base (11) with a depression (12), a controllable vacuum-pressure connection (bores 14, 16) at the depression (12), and a spherical cap (17), which is arranged in the depression (12), bears tightly against an annular surface (13) of the depressions (12) and has an opening (18) to the depression (12) and a sealing region (21) at the edge (20) of the spherical cap (17) for at least of the purposes of bearing against an optical surface of the spectacle lens in order to insert and remove the spectacle lens into or from a container and for of being mounted in and removed from a spectacle lens holding shaft (3, 7) in a spectacle lens edge processing machine (1) by means of a handling apparatus (9) which holds the base (11).

2. A holding device for use as claimed in claim 1, in which the annular surface (13) of the depression (12) is designed as a spherical surface complementary to the spherical cap (17).

3. The holding device for use as claimed in claim 1, in which the spherical cap (17) is movably fastened on the base (11) by means of a mushroom-shaped holder (22) guided through the opening (18).

4. The holding device for use as claimed in claim 1, in which the sealing region (21) is designed as a soft lip seal.

5. The holding device as claimed in one of claim 2, in which the base (11) is enlarged in the shape of a plate and supports at its edge region a retaining bolt (15) for fastening on the handling apparatus (9).

6. The holding device as claimed in claim 5, in which the vacuum-pressure connection (14, 16) is guided from the depression (12) through the plate-shaped enlargement (23) of the base (11) and the retaining bolt (15).

* * * * *